US008936039B2

(12) United States Patent
Kim et al.

(10) Patent No.: US 8,936,039 B2
(45) Date of Patent: Jan. 20, 2015

(54) COMMUNICATION APPARATUS, AIR CONDITIONING SYSTEM HAVING THE SAME AND COMMUNICATION METHOD THEREOF USING REFRIGERANT PIPES

(75) Inventors: Juntae Kim, Seoul (KR); Sangchul Youn, Seoul (KR); Seunghwan Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 987 days.

(21) Appl. No.: 13/044,169

(22) Filed: Mar. 9, 2011

(65) Prior Publication Data

US 2011/0219798 A1 Sep. 15, 2011

(30) Foreign Application Priority Data

Mar. 10, 2010 (KR) ..... 10-2010-0021463

(51) Int. Cl.

| | |
|---|---|
| ***H04B 11/00*** | (2006.01) |
| ***E21B 47/16*** | (2006.01) |
| ***F24F 1/00*** | (2011.01) |
| ***F24F 1/26*** | (2011.01) |
| ***F24F 1/32*** | (2011.01) |
| ***F24F 11/00*** | (2006.01) |

(52) U.S. Cl.

CPC ..... *F24F 1/0003* (2013.01); *F24F 1/26* (2013.01); *F24F 1/32* (2013.01); *F24F 11/0086* (2013.01)

USPC ..... 137/560; 137/551; 340/854.4

(58) Field of Classification Search

USPC ..... 137/551, 560; 340/854.4

See application file for complete search history.

(56) References Cited

U.S. PATENT DOCUMENTS

| | | | | |
|---|---|---|---|---|
| 6,348,876 | B1 * | 2/2002 | Wei et al. | 340/854.9 |
| 7,990,282 | B2 * | 8/2011 | Huang et al. | 340/854.4 |
| 2008/0032621 | A1 * | 2/2008 | Higuma et al. | 454/229 |

FOREIGN PATENT DOCUMENTS

| | | |
|---|---|---|
| CN | 1106583 A | 8/1995 |
| CN | 1930422 A | 3/2007 |
| JP | 6058602 | 3/1994 |
| WO | WO 97/21963 | 6/1997 |

OTHER PUBLICATIONS

Liang Xia, "Cable Television Technology", Analysis of reconstruction to wired bidirectional network in Nanhui District of Shanghai City, pp. 39-43, second voulme (2009).

* cited by examiner

*Primary Examiner* — Atif Chaudry

(74) *Attorney, Agent, or Firm* — McKenna Long & Aldridge LLP

(57) ABSTRACT

A communication apparatus, an air conditioning system having the same, and a communication method for the air conditioning system using a refrigerant pipe are provided. The refrigerant pipe may be used as a transmission line to allow communications between an outdoor unit and an indoor unit, and a low frequency band signal and a core having an inductance value appropriate for the characteristic of a pipe communication frequency may be used to perform the pipe communication, which allows communications between the outdoor unit and the indoor unit without a separate communication line, resulting in minimizing noise interruption and affection of surge, and avoiding signal strength attenuation and signal radiation.

20 Claims, 5 Drawing Sheets

COMMUNICATION APPARATUS, AIR CONDITIONING SYSTEM HAVING THE SAME AND COMMUNICATION METHOD THEREOF USING REFRIGERANT PIPES

Pursuant to 35 U.S.C. §119(a), this application claims the benefit of earlier filing date and right of priority to Korean Application No. 10-2010-0021463, filed on Mar. 10, 2010, the contents of which is incorporated by reference herein in its entirety as if fully set forth herein.

BACKGROUND

1. Field of the Disclosure

This disclosure relates to an air conditioning system, and particularly, to an air conditioning system capable of communicating data of an indoor unit or outdoor unit using a low frequency signal via a refrigerant pipe, and a communication method thereof using a refrigerant pipe.

2. Background

In general, an air conditioning system is provided with an indoor unit and an outdoor unit to drive a cooling or heating cycle in response to a user's demand. Here, the indoor unit and the outdoor unit are connected to each other via a refrigerant pipe.

Recently, a multi-type air conditioning system, which includes a plurality of multi air conditioners each having an outdoor unit for controlling distribution and circulation of a refrigerant, and indoor units sharing the outdoor unit to discharge air into each room, and a controller for connecting and controlling the plurality of air conditioners.

For example, as shown in FIG. 1, an air conditioning system includes one outdoor unit 200, and a plurality of indoor units 100A to 100D connected to the outdoor unit 200 via a refrigerant pipe 300.

Meanwhile, an air conditioning system may circulate a fluid, namely, a refrigerant, sequentially via a compressor, a condenser, an expansion valve and an evaporator, or in the reverse sequence, thereby performing cooling or heating for an indoor room. The refrigerant is refilled (supplemented) as much as being appropriate for a capacity of the air conditioning system upon installation of the air conditioning system. However, due to passage of time, namely, after prolonged use of the air conditioning system, the refrigerant is consumed, thereby causing the lack of refrigerant in the air conditioning system. If the refrigerant is insufficiently left, efficiency of the air conditioning system is lowered. So, the refrigerant should be refilled to maintain an appropriate level. Accordingly, to maintain an appropriate amount of refrigerant, which is consumed, a technique for constantly maintaining the amount of the refrigerant by injecting the refrigerant according to the capacity of the air conditioning system has been introduced.

The refrigerant pipe for connecting the indoor unit to the outdoor unit is installed within a building or the like in advance. If the number of outdoor units and indoor units is increased or the outdoor unit and the indoor unit are located at a farther distance, the length of the refrigerant pipe becomes longer, which increases the number of branches.

Hence, the air conditioning system and pipe communication method thereof according to the related art cause the following problems. That is, if a long pipe or a pipe with many branches is used, the outdoor unit and the indoor unit are located at a far distance from each other, which causes a communication signal to be weak (attenuated), thereby lowering reliability of the pipe communication.

Furthermore, in the air conditioning system and pipe communication method thereof according to the related art, upon performing communication via the refrigerant pipe, a signal frequency band is not concerned, thereby causing occurrence of noise interruption, attenuation of a signal strength and signal radiation.

SUMMARY OF THE DISCLOSURE

Therefore, to address the above-identified problems, an aspect of the detailed description is to disclose a pipe communication apparatus for transmitting or receiving data of an outdoor unit or an indoor unit using a signal of a low frequency band.

Another aspect of the detailed description is to disclose an air conditioning system capable of performing communications between an outdoor unit and an indoor unit using a refrigerant pipe as a transmission line, and performing pipe communications using a low frequency band signal and a pipe communication apparatus having a core with an inductance value suitable for the characteristic of a pipe communication frequency, and a pipe communication method for an air conditioning system using the refrigerant pipe.

To achieve these and other advantages and in accordance with the purpose of this specification, as embodied and broadly described herein, a pipe communication apparatus may be coupled to a refrigerant pipe to transfer data of an outdoor unit or indoor unit to the outdoor unit or indoor unit using a low frequency signal.

The apparatus may include a data communication unit configured to receive the data from the outdoor unit or indoor unit and output the data to the outdoor unit or indoor unit, and a signal converting unit configured to convert the data into the low frequency signal or the low frequency signal into the data.

The apparatus may further include a signal connecting unit having a magnetic core forming a specific inductance with respect to the low frequency signal and configured to connect the low frequency signal to the refrigerant pipe.

The apparatus may further include a signal coupling unit located between the signal converting unit and the signal connecting unit to filter the low frequency signal. The signal coupling unit may block noise and surge.

The apparatus may further include a signal amplifying unit located between the signal converting unit and the signal coupling unit and configured to amplify the low frequency signal.

To achieve the aspects of the detailed description, an air conditioning system may include at least one outdoor unit, at least one indoor unit connected to the outdoor unit via a refrigerant pipe and configured to perform air conditioning, and a pipe communication apparatus coupled to the refrigerant pipe and configured to transfer data of an outdoor unit or indoor unit to the outdoor unit or indoor unit using a low frequency signal.

The pipe communication apparatus may include a data communication unit configured to receive the data from the outdoor unit or indoor unit and output the data to the outdoor unit or indoor unit, a signal converting unit configured to convert the data into the low frequency signal or the low frequency signal into the data, and a signal coupling unit configured to filter the low frequency signal to couple the filtered low frequency signal to the refrigerant pipe. Here, the signal coupling unit may block noise and surge.

The pipe communication apparatus may further include a signal connecting unit having a magnetic core forming a specific inductance with respect to the low frequency signal and configured to connect the low frequency signal to the refrigerant pipe. Also, the pipe communication apparatus may further include a signal amplifying unit located between the signal converting unit and the signal coupling unit and configured to amplify the low frequency signal.

To achieve the aspects of the detailed description, a pipe communication method for an air conditioning system using a refrigerant pipe, the system comprising at least one outdoor unit and at least one indoor unit connected to the at least one outdoor unit via the refrigerant pipe to perform air conditioning, may be configured such that data of the outdoor unit or indoor unit is converted into a low frequency signal to be sent via the refrigerant pipe or a low frequency signal is received via the refrigerant pipe to be converted into the data.

To achieve the aspects of the detailed description a communication method for an air conditioning system using a refrigerant pipe, the system comprising at least one outdoor unit, at least one indoor unit connected to the at least one outdoor unit via the refrigerant pipe to perform air conditioning, and a pipe communication apparatus coupled to the refrigerant pipe to send or receive data of the outdoor unit or indoor unit, may include sending by the outdoor unit or indoor unit the data to the pipe communication apparatus, converting by the pipe communication apparatus the data into the low frequency signal, and sending by the pipe communication apparatus the low frequency signal to the refrigerant pipe.

The method may further include receiving by the pipe communication apparatus the low frequency signal from the refrigerant pipe, converting by the pipe communication apparatus the low frequency signal into the data, and sending by the pipe communication apparatus the data to the outdoor unit or indoor unit.

The method may further include filtering the low frequency signal. Also, the method may further include amplifying the low frequency signal.

In accordance with the communication apparatus, the air conditioning system having the same and the communication method for the air conditioning system using the refrigerant pipe according to the exemplary embodiments, the refrigerant pipe can be used as a transmission line to allow communications between the outdoor unit and the indoor unit, and the low frequency band signal and the core having the inductance value appropriate for the characteristic of the pipe communication frequency can be used to perform the pipe communication, which allows communications between the outdoor unit and the indoor unit without a separate communication line, which results in improving system stability and thus enhancing communication efficiency.

Also, the use of the low frequency band signal, the core having the inductance value appropriate for the characteristic of the pipe communication frequency and the signal coupling unit can allow the pipe communication, resulting in minimizing noise interruption and affection of surge.

The low frequency band signal and the core having the inductance value appropriate for the characteristic of the pipe communication frequency can be used to perform the pipe communication, and the signal amplifying unit can be provided to amplify a signal so as to be sent or received, thereby minimizing signal strength attenuation and signal radiation.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE DISCLOSURE

Description will now be given in detail of a pipe communication apparatus, an air conditioning system having the same and a pipe communication method for the air conditioning system according to the exemplary embodiments, with reference to the accompanying drawings.

A pipe communication apparatus in accordance with an exemplary embodiment may be connected to a refrigerant pipe and transfer data of an outdoor unit or an indoor unit to the outdoor unit or indoor unit using a low frequency signal.

Figure 3:
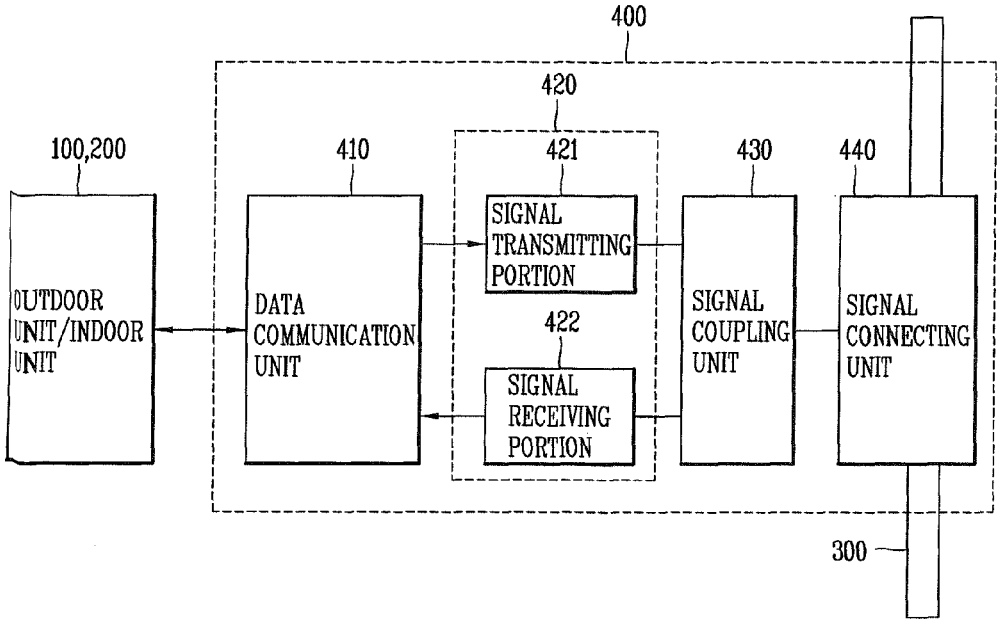
FIG. 3 is a block diagram schematically showing a configuration of a pipe communication apparatus in accordance with one exemplary embodiment.

Referring to FIG. 3, the pipe communication apparatus may include a data communication unit 410 for receiving the data from the outdoor unit 200 or indoor unit 100 and outputting the data to the outdoor unit 200 or indoor unit 100, and a signal converting unit 420 for converting the data into the low frequency signal or the low frequency signal into the data.

A carrier frequency of the low frequency signal may be designated in consideration of the characteristic of the refrigerant pipe 300, which is used as a transmission medium. That is, in order to couple the low frequency signal to the refrigerant pipe 300 and enhance communication reliability by reducing signal attenuation and interruption from external noise, use of frequencies at low frequency bands may be suitable. On the other hand, referring to FIG. 8, it can be found that the signal attenuation is reduced more when a higher frequency is used than a lower frequency being used. Also, a magnetic core with a small size can be used upon using a higher frequency signal, thereby obtaining an advantage of cost reduction. However, if a high frequency signal over several MHz, signal radiation may occur. Still referring to FIG. 8, a frequency band of the low frequency signal, which is used for pipe communication, is in the range of about 95 to about 150 KHz, namely, a frequency band satisfying frequency regulation of every country. Especially, the pipe communication apparatus and the pipe communication method according to this specification may employ a narrow band technology or dual frequency technology using a frequency of about 115 KHz or about 132 KHz, so as to reduce interruption generated due to various external noise and enhancing communication reliability.

Figure 8:
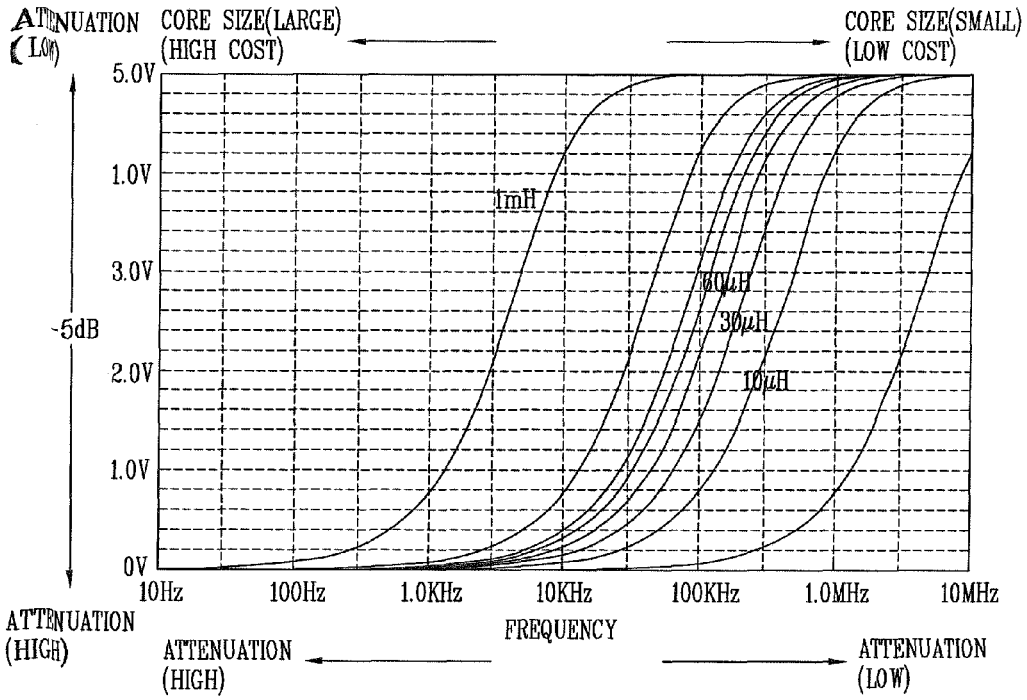
FIG. 8 is a view showing characteristics of communication signals used in the present disclosure according to frequency bands.

The pipe communication apparatus 400 may further include a signal connecting unit 440 having a magnetic core forming a specific inductance with respect to the low frequency signal and configured to link the low frequency signal to the refrigerant pipe. The magnetic core may operate as an inductance with respect to a frequency of a low frequency band so as to enhance the communication reliability, and also have a pipe coupling-available structure. An inductance value of the magnetic core may be in the range of about several tens of μH to several mH. Referring to FIG. 8, it may be preferable that the attenuation of the low frequency signal due to the magnetic core is lower than about 5 dB. Here, the inductance value due to the magnetic core may be in the range of about 30 to about 60 uH.

Figure 5:
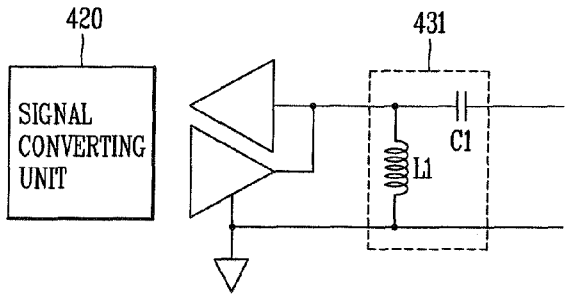
FIG. 5 is a view showing an example of a signal coupling unit.
Figure 6:
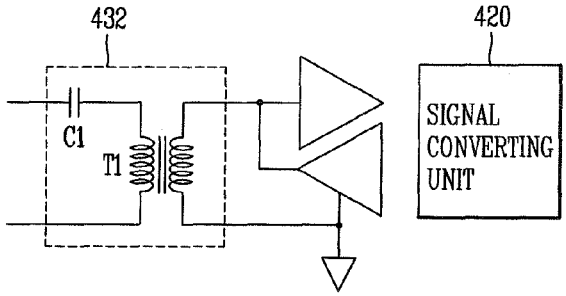
FIG. 6 is a view showing another example of the signal coupling unit.

Referring to FIGS. 3, 5 and 6, the pipe communication apparatus 400 may further include a signal coupling unit 430, 431, 432 located between the signal converting unit 420 and the signal connecting unit 440 for filtering the low frequency signal. The signal coupling unit 431, referring to FIG. 5, may include an inductor L1 and a capacitor C1 so as to filter the signal in a non-isolated manner. Also, the signal coupling unit 431 may block noise and surge. The signal coupling unit 432, referring to FIG. 6, may include a transformer T1 to block external noise and surge in a transformer-isolated manner.

Figure 7:
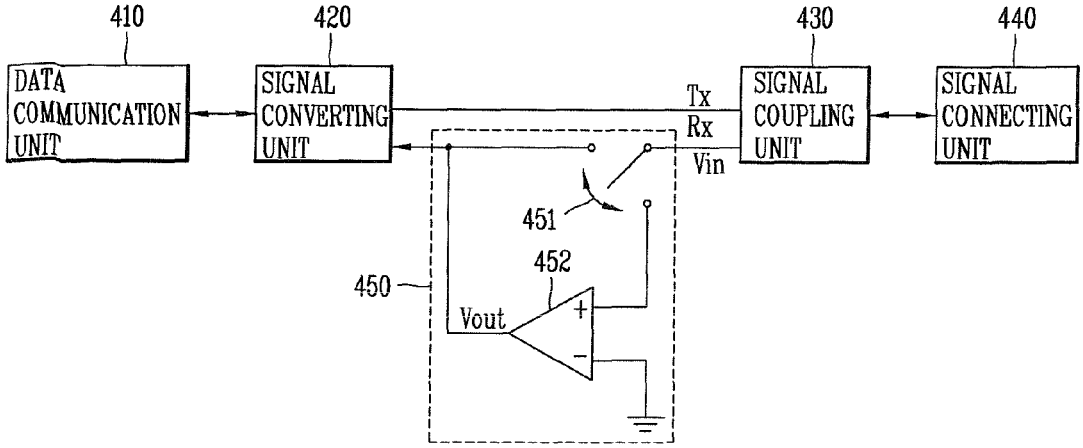
FIG. 7 is a block diagram schematically showing a configuration of a pipe communication apparatus in accordance with another exemplary embodiment.

Referring to FIG. 7, a pipe communication apparatus in accordance with another exemplary embodiment may include a data communication unit 410 for receiving data from the outdoor unit or indoor unit and outputting the data to the outdoor unit or indoor unit, a signal converting unit 420 for converting the data into the low frequency signal or the low frequency signal into the data, a signal connecting unit 440 having a magnetic core for forming a specific inductance with respect to the low frequency signal and configured to link the low frequency signal to the refrigerant pipe, a signal coupling unit 430 located between the signal converting unit 420 and the signal connecting unit 440 for filtering the low frequency signal, and a signal amplifying unit 450 located between the signal converting unit 420 and the signal coupling unit 430 for amplifying the low frequency signal. Here, the signal coupling unit 430 may block noise and surge. The like/similar components to those of the pipe communication apparatus according to the one exemplary embodiment will be understood by the corresponding description, so it will not be described again.

The signal amplifying unit 450 for increasing strength of the low frequency signal may be employed to cope with attenuation, which may occur in a signal received from the refrigerant pipe due to the length of the refrigerant pipe being lengthened. The signal amplifying unit 450 may include an amplification circuit for signal compensation (hereinafter, referred to as signal compensation amplification circuit), so as to amplify a signal by presetting a level (magnitude) of a reference signal (for example, 7 mV) and comparing a received signal with the reference signal. The signal amplifying unit 450 may be used for amplifying a signal being sent to the refrigerant pipe. The signal amplifying unit 450 may include the signal compensation amplification circuit, which is provided with a switch 451 for selecting a direct transfer of the signal or an amplification of the signal, and an amplifier (AMP) 452 for amplifying the signal.

Figure 1:
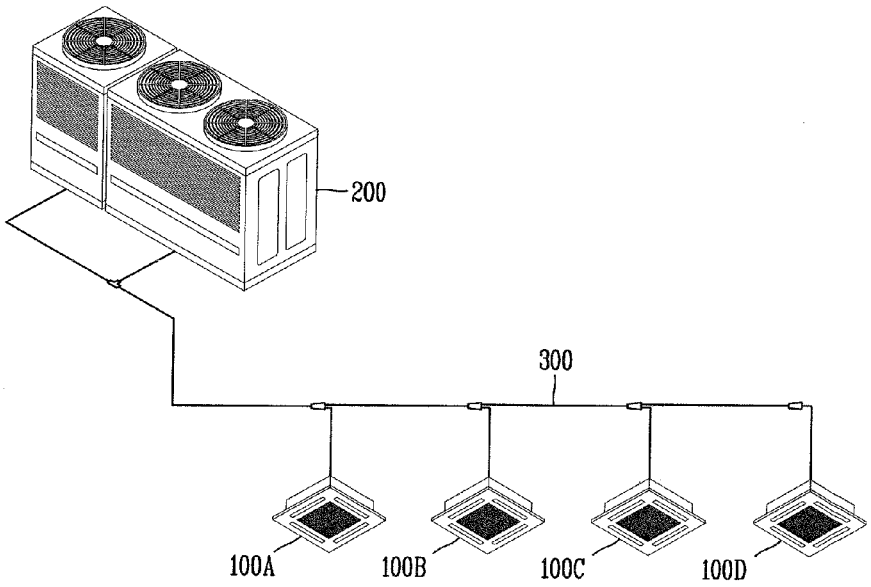
FIG. 1 is a schematic view showing a configuration of a related art air conditioning system.
Figure 2:
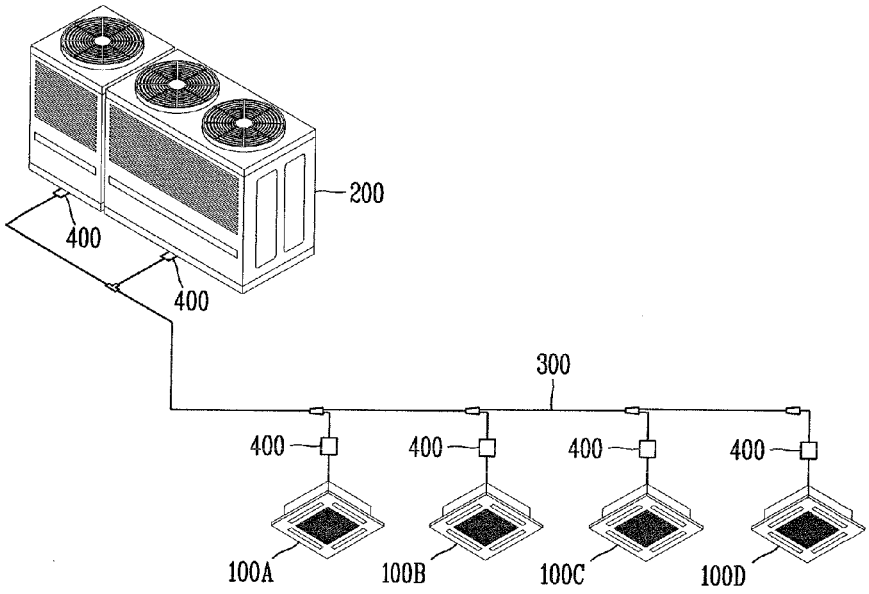
FIG. 2 is a schematic view showing a configuration an air conditioning system in accordance with an exemplary embodiment.

Referring to FIG. 2, the air conditioning system may include at least one outdoor unit 200, at least one indoor unit 100 connected to the outdoor unit 200 via a refrigerant pipe 300 for performing air conditioning, and a pipe communication apparatus 400 coupled to the refrigerant pipe 300 for transferring data of the outdoor unit 200 or the indoor unit 100 to the outdoor unit 200 or the indoor unit 100 using a low frequency signal.

Still referring to FIG. 3, the pipe communication apparatus 400 may include a data communication unit 410 for receiving data from the outdoor unit 200 or the indoor unit 100 and outputting the data to the outdoor unit 200 or the indoor unit 100, a signal converting unit 420 for converting the data into the low frequency signal or the low frequency signal into the data, and a signal coupling unit 430 for filtering the low frequency signal to couple the same to the refrigerant pipe 300. Here, the signal coupling unit 430 may block noise and surge.

The data communication unit 410 may be connected to a communication unit or a controller of the outdoor unit 200 or the indoor unit 100, so as to receive data, such as operation data, state information and the like, from the outdoor unit 200 or the indoor unit 100 or send such data to the outdoor unit 200 or the indoor unit 100. Here, the data communication unit 410 may be connected to the outdoor unit 200 or the indoor unit 100 through a general wired/wireless communication method, for example, RS-232c, RS-485, or LAN.

The signal converting unit 420 may include a signal transmitting portion 421 for converting, namely, encoding the data received by the data communication unit 410 into a low frequency signal so as to send toward the refrigerant pipe 300, and a signal receiving portion 422 for re-converting, namely, decoding the low frequency signal received from the refrigerant pipe 300 into the data format to send to the indoor unit 100 or the outdoor unit 200.

Figure 4:
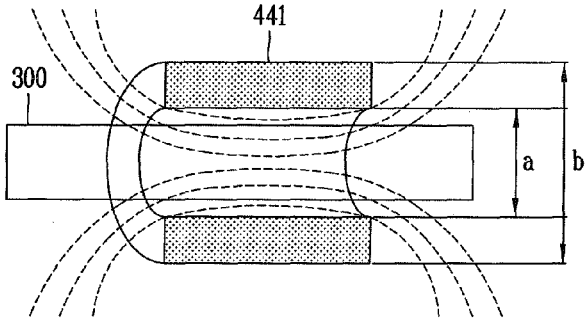
FIG. 4 is a view showing an example of a signal connecting unit.

Referring to FIG. 4, the pipe communication apparatus 400 may further include a signal connecting unit 440 having a magnetic core 441 forming a specific inductance with respect to the low frequency signal and configured to link the low frequency signal to the refrigerant pipe 300. The magnetic core 441 may operate as an inductance with respect to the low frequency signal. The inductance vale of the magnetic core 441 may be designated in consideration of the characteristic of the refrigerant pipe 300. The magnetic core 441 may be coupled to the refrigerant pipe 300. Hence, the magnetic core 441 may preferably have a structure of surrounding (winding) the refrigerant pipe 300, especially, a cylindrical structure as shown in FIG. 4. Here, the magnetic core 441 may have limitations to an inner diameter a, an outer diameter b and a thickness t. Also, since the refrigerant pipe 300 may pass through the center of the cylindrical core, the number N of turns of a signal line may be 1. That is, the inductance value of the magnetic core 441 applied to the pipe communication may be limited in a specific range as expressed by Equation 1.

$$L = \frac{N^2}{2\pi}\mu t \log\frac{b}{a} \qquad \text{[Equation 1]}$$

Here, L denotes an inductance, a denotes an inner diameter, b denotes an outer diameter, t denotes a thickness, N denotes the number of turns, and μ denotes a magnetic permeability.

Referring to FIG. 8, a frequency band of the low frequency signal, which is used for the pipe communication, may be in the range of about 95 to about 150 KHz, which may satisfy the frequency regulation of every country. Thusly, the inductance value of the magnetic core 441, which operates as the inductance of the frequency of the low frequency band to enhance communication reliability and has a pipe coupling-available structure, may be in the range of about several tens of μH to several mH. Especially, the pipe communication apparatus and the pipe communication method in this specification may employ a narrow band or dual frequency technology, which uses a frequency of about 115 KHz or about 132 KHz, which results in reduction of interruption from various external noise and improvement of communication reliability. Here, the attenuation of the low frequency signal by the magnetic core 441 may be set to be lower than about 5 dB. Here, the inductance value by the magnetic core 441 may be in the range of about 30 to about 60 uH. Also, a magnetic permeability of the magnetic core 441 may be about 10,000.

Referring to FIG. 7, the pipe communication apparatus 400 may further include a signal amplifying unit 450 present between the signal converting unit 420 and the signal coupling unit 430 for amplifying the low frequency signal. The signal amplifying unit 450 for amplifying the strength of the signal may be provided to cope with attenuation, which may occur in a signal received from the refrigerant pipe due to the length of the refrigerant pipe being lengthened. The signal amplifying unit 450 may include a signal compensation amplification circuit, so as to amplify a signal by presetting a level (magnitude) of a reference signal (for example, 7 mV) and comparing a received signal with the reference signal. The signal amplifying unit 450 may be used to amplify a signal being sent to the refrigerant pipe.

Figure 9:
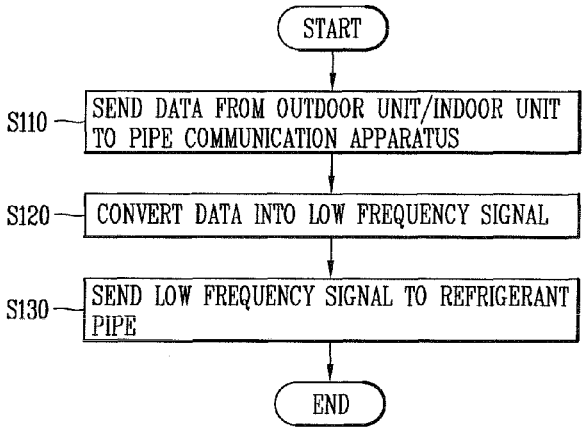
FIGS. 9 and 10 are flowcharts sequentially showing a pipe communication method for an air conditioning system in accordance with exemplary embodiments.
Figure 10:
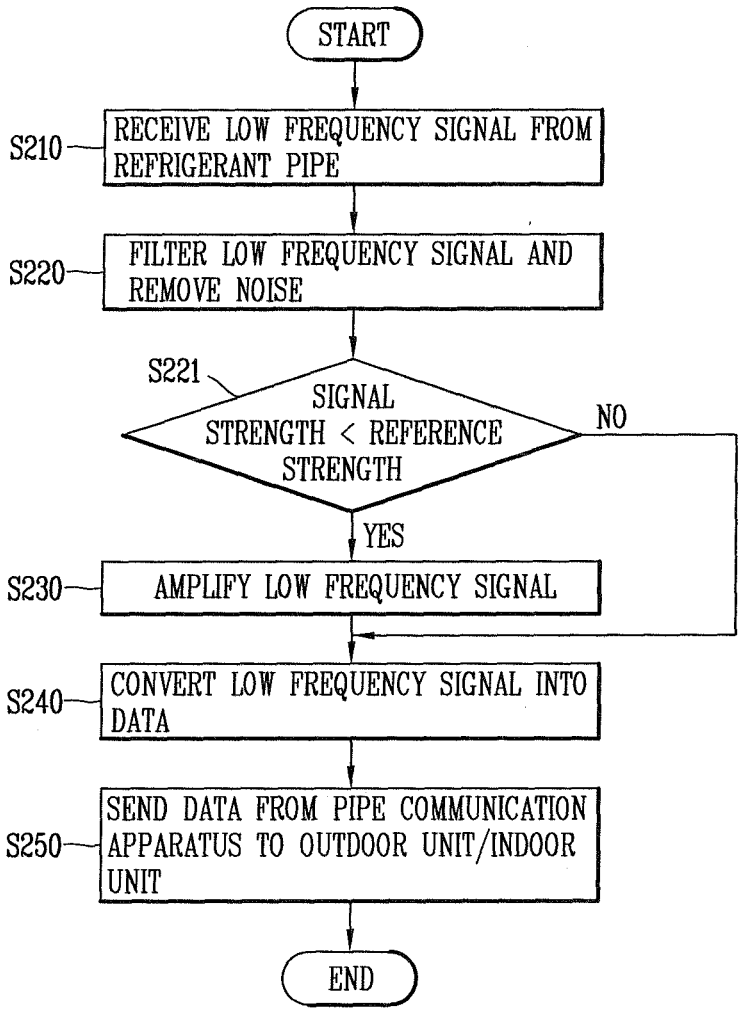

Referring to FIGS. 9 and 10, a pipe communication method for an air conditioning system, which includes at least one outdoor unit and at least one indoor unit connected to the outdoor unit via a refrigerant pipe for performing air conditioning, may be configured to convert data of the outdoor unit or indoor unit into a low frequency signal to send the converted data via the refrigerant pipe and receive the low frequency signal via the refrigerant pipe to convert the same into the data.

A carrier frequency of the low frequency signal used in the pipe communication method may be designated in consideration of characteristics of the refrigerant pipe 300, which is used as a transmission medium. That is, in order to couple the low frequency signal to the refrigerant pipe 300 and enhance communication reliability by reducing signal attenuation and interruption from external noise, use of frequencies at low frequency bands may be suitable. On the other hand, referring to FIG. 8, it can be found that the signal attenuation is reduced more when a higher frequency is used than a lower frequency being used. Also, a magnetic core with a small size can be used upon using a higher frequency signal, thereby obtaining an advantage of cost reduction. However, if a high frequency signal over several MHz, signal radiation may occur. Still referring to FIG. 8, a frequency band of the low frequency signal, which is used for pipe communication, is in the range of about 95 to about 150 KHz, namely, a frequency band satisfying frequency regulation of every country. Especially, the pipe communication apparatus and the pipe communication method according to this specification may employ a narrow band technology or dual frequency technology using a frequency of about 115 KHz or about 132 KHz, so as to reduce interruption generated due to various external noise and enhancing communication reliability The magnetic core 441, which is required to couple the pipe communication apparatus 400 to the refrigerant pipe 300, may operate as the inductance with respect to the low frequency signal. The inductance value of the magnetic core 441 may be designated in consideration of the characteristic of the refrigerant pipe 300. Hence, the magnetic core 441 may preferably have a structure of surrounding (winding) the refrigerant pipe 300, especially, a cylindrical structure as shown in FIG. 4. It may be preferable that the attenuation of the low frequency signal due to the magnetic core 441 is lower than about 5 dB. Here, the inductance value by the magnetic core 441 may be in the range of about 30 to about 60 uH.

Referring to FIG. 9, a pipe communication method for an air conditioning system, which includes at least one outdoor unit, at least one indoor unit connected to the outdoor unit via a refrigerant pipe for performing air conditioning, and a pipe communication apparatus coupled to the refrigerant pipe for transmitting and receiving data of the outdoor unit or indoor unit, may include sending the data from the outdoor unit or indoor unit to the pipe communication apparatus (S110), converting by the pipe communication apparatus the data into the low frequency signal (S120), and sending by the pipe communication apparatus the low frequency signal to the refrigerant pipe (S130). Hereinafter, the configuration of the pipe communication apparatus will be understood with reference to FIGS. 2 to 8.

In order for the outdoor unit or indoor unit to send or receive data via the refrigerant pipe, the outdoor unit or indoor unit sends data to the pipe communication apparatus (S110). The pipe communication apparatus then receives the data via the data communication unit 410. The pipe communication apparatus converts the received data into a low frequency signal via the signal converting unit 420 using a carrier frequency of the frequency band (S120), and then sends the converted low frequency signal to the refrigerant pipe (S130). Here, the pipe communication apparatus filters the low frequency signal via the signal coupling unit 430 to transfer to the refrigerant pipe via the signal connecting unit 440 having the magnetic core 441.

The pipe communication method may further include amplifying the low frequency signal (not shown).

Referring to FIG. 10, a pipe communication method for an air conditioning system may include receiving by the pipe communication apparatus the low frequency signal from the refrigerant pipe (S210), converting by the pipe communication apparatus the low frequency signal into the data (S240), and sending by the pipe communication apparatus the data to the outdoor unit or indoor unit (S250). The pipe communication method may further include filtering the low frequency signal (S220). The pipe communication method may further include amplifying the low frequency signal (S230). Hereinafter, the configuration of the pipe communication apparatus will be understood with reference to FIGS. 2 to 8.

The pipe communication apparatus receives the low frequency signal from the refrigerant pipe 300 via the signal connecting unit 440 (S210). The pipe communication apparatus then filters the received low frequency signal via the signal coupling unit 430 to remove noise and block surge (S220). The pipe communication apparatus converts the low frequency signal via the signal receiving portion 422 of the signal converting unit 420 into a data format useable in the outdoor unit or indoor unit (S240). The pipe communication apparatus then amplifies the received low frequency signal via the signal amplifying unit 450 prior to the conversion. The signal amplifying unit 450 may include a signal compensation amplification circuit to preset the level of a reference signal (for example 7 mV), compare the received signal with the reference signal, and amplify the signal if the signal is smaller than the reference signal (S221, S230). The pipe communication apparatus thusly sends the converted data to the outdoor unit or indoor unit via the data communication unit 410 (S250).

As described above, in accordance with the pipe communication apparatus, the air conditioning system having the same, and a pipe communication method for the air conditioning system, the refrigerant pipe can be used as a transmission line so as to perform communication between the outdoor unit and the indoor unit, and also the pipe communication can be performed using a signal of a low frequency band and a core having an inductance value suitable for a pipe communication frequency characteristic, thereby allowing communication between the outdoor unit and the indoor unit without separate use of a communication line, resulting in minimizing noise interruption and affection of surge and avoiding signal strength attenuation and signal radiation.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A pipe communication system comprising:

an outdoor unit;

an indoor unit;

a refrigerant pipe connected to and transporting refrigerant between the outdoor unit and the indoor unit; and a communication device coupled to the refrigerant pipe to transfer data back and forth between the outdoor unit and the indoor unit using a low frequency signal via the refrigerant pipe formed of electrically conductive material; and wherein the low frequency signal is a signal of a frequency band in the range of about 95 to about 150 KHz.

2. The system of claim 1, wherein the communication device comprises:

a data communication unit configured to receive the data between the outdoor unit and the indoor unit; and a signal converting unit configured to convert the data into the low frequency signal or the low frequency signal into the data.

3. The system of claim 2, further comprising a signal connecting unit having a magnetic core forming a specific inductance with respect to the low frequency signal and configured to connect the low frequency signal to the refrigerant pipe.

4. The system of claim 3, further comprising a signal coupling unit located between the signal converting unit and the signal connecting unit and configured to filter the low frequency signal.

5. The system of claim 4, wherein the signal coupling unit blocks noise and surge.

6. The system of claim 4, further comprising a signal amplifying unit located between the signal converting unit and the signal coupling unit and configured to amplify the low frequency signal.

7. The system of claim 1, wherein the low frequency signal is a signal of a frequency band in the range of about 95 to about 150 KHz in order to avoid both signal strength attenuation and signal radiation.

8. An air conditioning system comprising:

one or more outdoor units;

one or more indoor units connected to an outdoor unit via a refrigerant pipe and configured to perform air conditioning; and a pipe communication apparatus coupled to the refrigerant pipe and configured to transfer data back and forth between the outdoor unit and the indoor unit using a low frequency signal via the refrigerant pipe formed of electrically conductive material; and wherein the low frequency signal is a signal of a frequency band in the range of about 95 to about 150 KHz.

9. The system of claim 8, wherein the pipe communication apparatus comprises:

a data communication unit configured to receive the data from the outdoor unit or indoor unit and output the data to the outdoor unit or indoor unit;

a signal converting unit configured to convert the data into the low frequency signal or the low frequency signal into the data; and a signal coupling unit configured to filter the low frequency signal to couple the filtered low frequency signal to the refrigerant pipe.

10. The system of claim 9, wherein the signal coupling unit blocks noise and surge.

11. The system of claim 9, wherein the pipe communication apparatus further comprises a signal connecting unit having a magnetic core forming a predetermined inductance with respect to the low frequency signal and configured to connect the low frequency signal to the refrigerant pipe.

12. The system of claim 11, wherein the pipe communication apparatus further comprises a signal amplifying unit located between the signal converting unit and the signal coupling unit and configured to amplify the low frequency signal.

13. The system of claim 8, wherein the low frequency signal is a signal of a frequency band in the range of about 95 to about 150 KHz in order to avoid both signal strength attenuation and signal radiation.

14. A communication method for an air conditioning system using a refrigerant pipe, the system comprising at least one outdoor unit and at least one indoor unit connected to the at least one outdoor unit via the refrigerant pipe to perform air conditioning, the method comprising:

receiving a low frequency signal or data communicated from one of the outdoor unit or the indoor unit via the refrigerant pipe formed of electrically conductive material; and converting data into a low frequency signal or the low frequency signal into data; and wherein the low frequency signal is a signal of a frequency band in the range of about 95 to about 150 KHz.

15. The method of claim 14, wherein the low frequency signal is a signal of a frequency band in the range of about 95 to about 150 KHz in order to avoid both signal strength attenuation and signal radiation.

16. A communication method for an air conditioning system using a refrigerant pipe, the system comprising at least one outdoor unit, at least one indoor unit connected to the at least one outdoor unit via the refrigerant pipe to perform air conditioning, and a pipe communication apparatus coupled to the refrigerant pipe to send or receive data from the outdoor unit or the indoor unit, the method comprising:

sending from the outdoor unit or indoor unit the data to the pipe communication apparatus;

converting the data into a low frequency signal; and sending the low frequency signal to the refrigerant pipe formed of electrically conductive material; and wherein the low frequency signal is a signal of a frequency band in the range of about 95 to about 150 KHz.

17. The method of claim 16, further comprising:

receiving the low frequency signal from the refrigerant pipe;

converting the low frequency signal into the data; and sending the data to the outdoor unit or the indoor unit.

18. The method of claim 16, further comprising filtering the low frequency signal.

19. The method of claim 18, further comprising amplifying the low frequency signal.

20. The method of claim 16, wherein the low frequency signal is a signal of a frequency band in the range of about 95 to about 150 KHz in order to avoid both signal strength attenuation and signal radiation.

* * * * *